US008869354B2

(12) United States Patent
Horimoto

(10) Patent No.: US 8,869,354 B2
(45) Date of Patent: Oct. 28, 2014

(54) RATCHET BUCKLE FOR HELMETS

(75) Inventor: Takayuki Horimoto, Tokyo (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 13/990,665

(22) PCT Filed: Nov. 8, 2011

(86) PCT No.: PCT/JP2011/075653
§ 371 (c)(1),
(2), (4) Date: May 30, 2013

(87) PCT Pub. No.: WO2012/077446
PCT Pub. Date: Jun. 14, 2012

(65) Prior Publication Data

US 2013/0239375 A1 Sep. 19, 2013

(30) Foreign Application Priority Data

Dec. 7, 2010 (JP) ..... 2010-272215

(51) Int. Cl.

| | |
|---|---|
| ***A43C 11/00*** | (2006.01) |
| ***A42B 3/08*** | (2006.01) |
| ***A44B 11/16*** | (2006.01) |
| ***A44B 11/10*** | (2006.01) |
| ***A44B 11/06*** | (2006.01) |

(52) U.S. Cl.
CPC ..... *A44B 11/065* (2013.01); *A42B 3/08* (2013.01); *A44B 11/16* (2013.01); *A44B 11/10* (2013.01)
USPC ..... 24/69 ST

(58) Field of Classification Search
USPC ..... 24/68 SK, 69 ST, 68 B, 71 SK, 71 ST
See application file for complete search history.

(56) References Cited

U.S. PATENT DOCUMENTS

| | | | | |
|---|---|---|---|---|
| 2,673,381 | A * | 3/1954 | Dueker | 24/712 |
| 5,642,555 | A * | 7/1997 | Lin | 24/70 SK |
| 6,457,210 | B1 | 10/2002 | Shirai et al. | |
| 6,561,398 | B1 * | 5/2003 | Cole et al. | 224/324 |
| 6,609,276 | B1 * | 8/2003 | Lin | 24/68 SK |
| 6,859,981 | B2 * | 3/2005 | Hsiao | 24/68 SK |
| 7,802,808 | B2 * | 9/2010 | Neiley | 280/623 |
| 7,877,845 | B2 * | 2/2011 | Signori | 24/68 SK |
| 2002/0189056 | A1 | 12/2002 | Gallina et al. | |

FOREIGN PATENT DOCUMENTS

| | | | |
|---|---|---|---|
| JP | S60-104508 | A1 | 6/1985 |
| JP | H11-302915 | A1 | 11/1999 |
| JP | 2003-033208 | A1 | 2/2003 |
| JP | 2004-000501 | A1 | 1/2004 |
| JP | 2006-204691 | A1 | 8/2006 |
| JP | 2011-142956 | A1 | 7/2011 |
| WO | 02-28213 | A1 | 4/2002 |

* cited by examiner

*Primary Examiner* — Victor Batson
*Assistant Examiner* — Matthew Sullivan
(74) *Attorney, Agent, or Firm* — Law Office of Katsuhiro Arai

(57) ABSTRACT

Provided is a ratchet buckle for helmets wherein an engagement/releasing member having an engagement part is assembled to the buckle, via a pin, between the base member and operating member, and therefore when the operating member is pulled up and rotated in the counterclockwise direction, the front end of the operating member contacts the front end of the engagement/releasing member and the engagement with the tab of the ratchet is released by rotation of the engagement part of the engagement/releasing member, and because the engagement is released by pulling up the operating member by at least twice the conventional pull-up distance, the helmet will not come off from the head as a result of a wrong or inadvertent lever operation and thus safety can be ensured, while the thickness of the ratchet buckle can be kept small.

7 Claims, 5 Drawing Sheets

RATCHET BUCKLE FOR HELMETS

This application is the U.S. National Phase under 35 U.S.C. §371 of International Application PCT/JP2011/075653, filed Nov. 8, 2011, which claims priority to Japanese Patent Application No. 2010-272215, filed Dec. 7, 2010. The International Application is to be published under PCT Article 21(2) in a language other than English.

TECHNICAL FIELD

The present invention relates to a ratchet buckle for helmets used for construction helmets, motorcycle helmets, etc. Specifically, it relates to a ratchet buckle for helmets comprising a ratchet fastened to a strap provided inside a helmet, and a buckle through which the ratchet is inserted, wherein an end of the ratchet is inserted into the buckle to engage multiple ratchet tabs with the buckle, and the engagement is released by a pull-up operation.

PRIOR ART

Among known ratchet buckles for helmets of this type are buckles designed to cause their band and buckle to engage with each other reliably, and the engagement can be released with ease. For example, the buckle for construction helmets described in Patent Literature 1 relates to a helmet constructed with a helmet, a hammock provided inside the helmet, and a band with buckle which is provided inside the helmet and used to surround the user's head. As shown in FIG. 13, the base end of a releasing member 11 has a releasing part 15 formed on it which is used to raise a free end 9 of an elastic member 7 when an operating part 16 is pressed. The releasing part 15 is positioned on the opposite side of the operating part 16 with respect to bearings 12, 12, where pressing the operating part 16 causes the releasing part 15 to be raised around the bearings 12, 12 functioning as fulcrums, due to the principle of leverage, with the free end 9 of the elastic member 7 also raised. This way, an engagement part 10 comes off from a concave part 1 of a band 3 and the engaged band 3 is released as a result. The proposed buckle for construction helmets is such that, when releasing the band, the elastic member can be displaced by pressing the releasing member with a relatively small force because the principle of leverage is used as mentioned above (refer to Patent Literature 1).

With the aforementioned helmet buckle, where pressing down the operating part 16 that releases the engagement allows for easy release of the engaged band 3, which means that pressing down the operating part 16 by mistake may cause the helmet to come off from the user's head.

Particularly with respect to construction or motorcycle helmets, where a dangerous situation that threatens human life can occur if the helmet comes off, ratchet buckles are known which are used for construction or motorcycle helmets and designed in such a way that the engagement is released not by a press-down action, but by a push-up action instead, to ensure safety. For example, a toothed belt fastener 1 for construction or motorcycle helmets shown in FIG. 14 ("tooth-meshed belt fastener" is a mistranslation of what should be correctly translated as "toothed belt fastener" corresponding to a "ratchet buckle") has a first fastening member 2 (ratchet) and second fastening member 3 (buckle), and this ratchet and buckle are fixed at ends 4, 5, respectively, of the chin strap of the helmet or other article and can be engaged in an adjustable manner.

A first ratchet 14 functions as a buckle operating member in that it engages with a ratchet tooth and this engagement is released by pulling up one end of a lever 16. This first ratchet 14 is elastically energized by means of a coil spring. The ratchet buckle 1, while it is engaged, has its tooth 19 (engagement tab) engaged with a tooth 7 (ratchet tooth) on a belt (toothed belt). It is proposed that the ratchet buckle is such that, when one end of the lever 16 of the first ratchet 14 (operating member) is pulled up and rotated around a base 10 (base member) to release the fastener (ratchet buckle), the engagement of the engagement tab 19 and ratchet tooth 7 is released (refer to Patent Literature 2).

In other words, the aforementioned ratchet buckle for helmets is constructed in such a way that: an operating member is assembled to a base member which is the basic structure of the buckle, via a pin through which coil springs are inserted, and the operating member is energized in the clockwise direction; multiple tabs for engagement are provided on the surface of the ratchet; an engagement part that selectively engages with one of the multiple tabs is provided inside the buckle; an end of the ratchet is inserted into the buckle to cause the engagement part to selectively engage with one of the multiple tabs; and this engagement is released by pulling up the operating member provided on the buckle.

PRIOR ART LITERATURES

Patent Literatures

Patent Literature 1: Japanese Patent Laid-open No. 2004-501

Patent Literature 2: Japanese Patent Laid-open No. 2003-33208

SUMMARY OF THE INVENTION

Problems to be Solved by the Invention

The ratchet buckle 1 described in Patent Literature 2 is such that by pulling up the lever 16 to the position at which the engagement of the engagement tab 19 and ratchet tooth 7 is released, the engagement is released by means of the rotation of the engagement tab 19. However, a short pull-up distance until the engagement is released means that, if the lever 16 is pulled up even slightly by mistake, the engagement may be released easily and the helmet may come off from the head. Particularly with a motorcycle helmet, where a dangerous situation that affects human life can occur when the helmet comes off as a result of a wrong or inadvertent lever operation, it is extremely dangerous that the pull-up distance of the lever 16 is short. One possible way to avoid this potential danger is to raise, the height of the ratchet tooth 7 and that of the engagement tab 19 so as to increase the pull-up distance of the lever, but any increase in the pull-up distance is minimal, and wrong or inadvertent lever operation still cannot be avoided. Additionally, raising these heights increases the thickness of the buckle, thereby presenting a problem that the thickness of the ratchet buckle cannot be reduced.

Accordingly, in light of the problems of the aforementioned prior arts, the object of the present invention is to provide a ratchet buckle for helmets wherein the lever pull-up distance until the engagement of the engagement tab and ratchet tooth is released is made longer to prevent the helmet from coming off from the head as a result of a wrong or inadvertent lever operation and thereby ensure safety, while the thickness of the buckle is kept small.

Means for Solving the Problems

After repeatedly studying in earnest to achieve the aforementioned object, the inventor of the present invention found that the operating distance for release could be increased to at least twice as long as the conventional distance by providing an engagement/releasing member between the base member at which the ratchet is inserted through the buckle, and the operating member (lever), and consequently completed the present invention.

That is, the present invention is described as follows.

The ratchet buckle for helmets embodied by Embodiment 1 of the present invention comprises a ratchet which is fastened to a strap provided inside the helmet, and a buckle: wherein an operating member is assembled to a base member which is the basic structure of the buckle, via a pin through which coil springs are inserted, and the operating member is energized in the clockwise direction; multiple tabs for engagement are provided on the surface of the ratchet; an engagement part that selectively engages with one of the multiple tabs is provided inside the buckle; an end of the ratchet is inserted into the buckle to cause the engagement part to selectively engage with one of the multiple tabs; and this engagement is released by pulling up the operating member provided on the buckle; and such ratchet buckle for helmets is characterized in that an engagement/releasing member having the engagement part is assembled, via the pin, between the base member and operating member of the buckle, and when the operating member is pulled up and rotated in the counterclockwise direction, the front end of the operating member contacts the front end of the engagement/releasing member and the engagement part of the engagement/releasing member rotates to release the engagement with the tab of the ratchet.

The ratchet buckle for helmets embodied by Embodiment 2 of the present invention is characterized in that the engagement/releasing member has side wall parts comprising side plates and engagement/releasing parts comprising a bottom plate, wherein the side wall parts have through holes provided in them for inserting the pin, and the engagement/releasing parts have an engagement part that engages with the tab of the ratchet as well as releasing convex parts that release the engagement with the tab of the ratchet as a result of a pull-up operation of the operating member.

The ratchet buckle for helmets embodied by Embodiment 3 of the present invention is characterized in that the engagement part has a rectangular shape which inclines from the front toward the rear and is also pressed from both ends into a trapezoidal shape, and the releasing convex parts are formed as circular convexes on the inner side at the tip.

The ratchet buckle for helmets embodied by Embodiment 4 of the present invention is characterized in that the side wall parts have locking parts for the trapezoidal convex part at their rear ends.

The ratchet buckle for helmets embodied by Embodiment 5 of the present invention is characterized in that the front end of the operating member is such that a pressing convex part having a convex flat shape is provided at both ends on the front.

The ratchet buckle for helmets embodied by Embodiment 6 of the present invention is characterized in that the front end of the operating member comprises the pressing convex parts, while the front end of the engagement/releasing member comprises the releasing convex parts, and when the pressing convex parts contact the releasing convex parts and the engagement part of the engagement/releasing member rotates, the engagement with the tab of the ratchet is released.

The ratchet buckle for helmets embodied by Embodiment 7 of the present invention is characterized in that the pull-up force of the operating member is low but sufficient to counter the energy of the coil springs until the pressing convex parts contact the releasing convex parts, but it becomes and remains strong until the engagement of the ratchet and buckle is released in order to shorten the distance over which the ratchet and buckle remain engaged.

The ratchet buckle for helmets according to Embodiment 8 of the present invention is characterized in that the engagement is released by pulling up the operating member by at least twice a conventional pull-up distance of 1.

Effects of the Invention

The ratchet buckle for helmets proposed by the present invention can be manufactured with ease by simply assembling via a pin an engagement/releasing member having an engagement part, between the base member and operating member, and because the engagement is released by pulling up the operating member over at least twice the conventional distance, the helmet will not come off from the head as a result of a wrong or inadvertent lever operation and thus safety can be ensured, while the thickness of the ratchet buckle can be kept small.

In addition, the ratchet buckle for helmets proposed by the present invention requires a lower manufacturing cost because the base member and engagement/releasing member can be formed with ease by stamping a stainless steel sheet material. Also, because surfaces of the members having the thickness of this stainless steel sheet material come into contact as two stages, one between the tab and engagement part and the other between the tab and both ends of the center convex part, neither component will be damaged even when the helmet receives strong impact from the outside.

Furthermore, the force with which to pull up the operating member of the ratchet buckle for helmets proposed by the present invention is low but sufficient to counter the energy of the coil springs until the pressing convex parts contact the releasing convex parts, but the pull-up force applied until the engagement of the ratchet and buckle is released must be strong enough to shorten the distance over which the ratchet and buckle remain engaged, and this long pull-up distance of the operating member and changing pull-up force can prevent any wrong or inadvertent lever operation.

DESCRIPTION OF THE SYMBOLS

Figure 1:
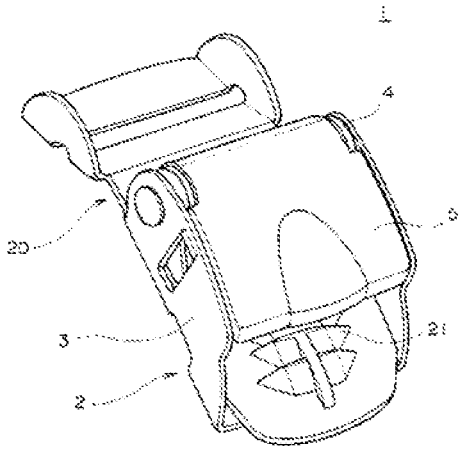
FIG. 1 is a perspective view showing the exterior of a ratchet buckle for helmets.

1 Ratchet buckle for helmets
2 Buckle
20 Ratchet
21 Tab
24 Curved part
3 Base member
31 Through hole
32 Side wall part
33 Ratchet insertion part
34 Strap engagement part
35 Strap engagement hole
36 Coil spring affixing part
4 Engagement/releasing part
41 Through hole
42 Side wall part
42' Locking part
43 Engagement/releasing part
44 Releasing convex part
45 Engagement part
46 Center convex part
5 Operating member
51 Through hole
52 Pressing convex part
53 Operating part
6 Pin
7 Coil spring

MODE FOR CARRYING OUT THE INVENTION

The best mode for carrying out the present invention is explained below by referring to the attached drawings.

FIG. 1 is a perspective view showing the exterior of a ratchet buckle for helmets according to the present invention.

A ratchet buckle for helmets 1 comprises a ratchet 20 fastened to a strap provided inside a helmet, and a buckle 2 through which the ratchet 20 is inserted. Multiple tabs 21 for engagement are provided on the surface of the ratchet 20, while an engagement part (not illustrated) that selectively engages with one of the multiple tabs 21 is provided inside the buckle 2, so that an end of the ratchet 20 is inserted into the buckle 2 to cause the engagement part to selectively engage with one of the multiple tabs 21, and the engagement is released by an operating member 5 provided on the buckle 2.

It should be noted that FIGS. 2 to 12 referenced and explained below are oriented in such a way that the front of the buckle 2, or the side on which the ratchet is inserted, defines the left.

Figure 2:
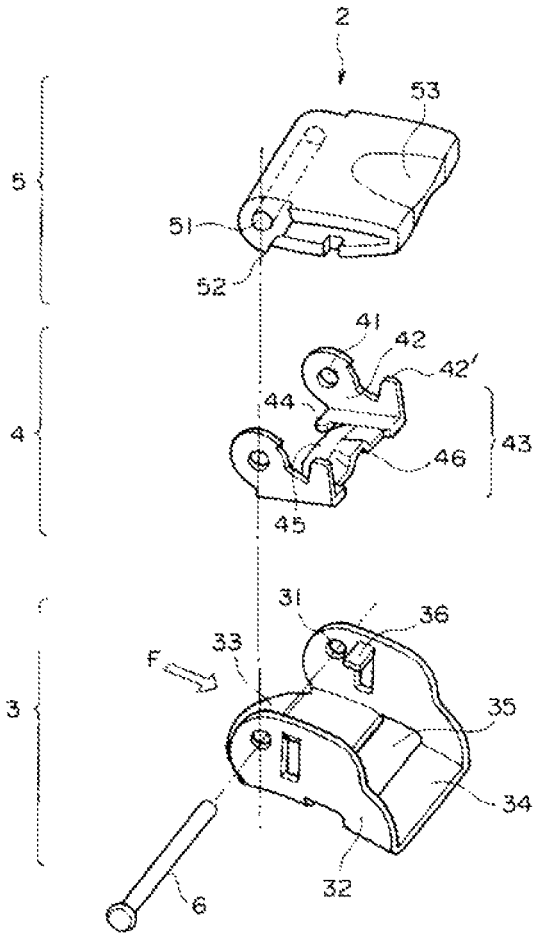
FIG. 2 is an exploded perspective view of the buckle in FIG. 1.

FIG. 2 is an exploded perspective view of the buckle in FIG. 1. The buckle 2 comprises a base member 3 through which the ratchet 20 is inserted, an engagement/releasing member 4 having an engagement part 45, and the operating member 5 to be pulled up to release the engagement. This base member 3 and engagement/releasing member 4 are made of metal, preferably iron, stainless steel, or other strong metal, of which stainless steel is most preferable as it does not rust. The operating member 5 is preferably made of plastic as it is lightweight and easy to process. Also, the base member 3, engagement/releasing member 4, and operating member 5 are provided in such a way that coaxial through holes 31, 41, 51 are punched in the respective side wall parts on the insertion side of the ratchet 20 and a pin 6 is inserted into these through holes, so that the engagement/releasing member 4 and operating member 5 can be rotated around the pin 6.

The base member 3 is a buckle component manufactured to the structure shown in FIG. 2 by pressing a stainless steel sheet material, and symbols 31 to 36 are assigned with corresponding names to respective parts of this component according to the function or shape of each part. This base member 3 is a structural member of the buckle and comprises through holes 31, 31, side wall parts 32, 32, ratchet insertion part 33, strap engagement part 34, strap engagement hole 35, and coil spring affixing parts 36, 36. The ratchet insertion part 33 guides the ratchet 20 which is inserted from direction F into the buckle 2, while the strap engagement part 34 engages the strap provided inside the helmet through the strap engagement hole 35. The coil spring affixing parts 36, 36 will be explained later.

The engagement/releasing member 4 is a buckle component manufactured to the structure shown in FIG. 2 by stamping a metal sheet material, and symbols 41 to 46 are assigned names corresponding to respective parts of this component according to the function or shape of each part, just like the base member 3. This engagement/releasing member 4 has side wall parts 42, 42 comprising side plates, and engagement/releasing parts 43, 43 comprising a bottom plate, and the side wall parts 42, 42 comprising the side plates have through holes 41, 41 provided in them for inserting the pin 6 and rotating the engagement/releasing member 4, while the engagement/releasing parts 43, 43 comprising the bottom plate have an engagement part 45 that engages with the tab 21 of the ratchet 20 as well as releasing convex parts 44, 44 that release the engagement with the tab 21 of the ratchet 20 by a pull-up operation of the operating member 5.

To be specific, the engagement/releasing parts 43, 43 comprising the bottom plate extend inward at right angles from the side wall parts 42, 42, and the releasing convex parts 44, 44 are formed as circular convexes in the inward direction on the inner side at their tips. The engagement/releasing parts 43, 43 are bridged by a rectangular engagement part 45 and center convex part 46 provided between them, and the rectangular engagement part 45 inclines from the front to the rear and is also stamped from both ends into a trapezoidal shape. The rear end of the engagement part 45 engages with the tab 21 of the ratchet 20. Here, a pull-up operation of the operating member 5 causes pressing convex parts 52, 52 (explained later) of the operating member 5 to contact the releasing convex parts 44, 44 so that the engagement/releasing member 4 rotates in the counterclockwise direction to release the engagement with the tab 21 of the ratchet 20. Once the engagement is released, the operating member 5 rotates in the clockwise direction and contacts locking parts 42', 42' of the trapezoidal convex part provided at the rear ends of the side wall parts 42, 42, thereby returning to the position assumed before the ratchet 20 was inserted.

The center convex part 46 has its both ends stamped so as to incline according to the shape convexed at the center.

As described above, the engagement/releasing member 4 comprises the through holes 41, 41, side wall parts 42, 42, locking parts 42', 42', engagement/releasing parts 43, 43, engagement part 45, and center convex part 46.

The operating member 5, comprised of a synthetic resin injection molding, is a buckle component formed to the structure shown in FIG. 2 and comprises through holes 51, 51, pressing convex parts 52, 52 and operating part 53.

Figure 3:
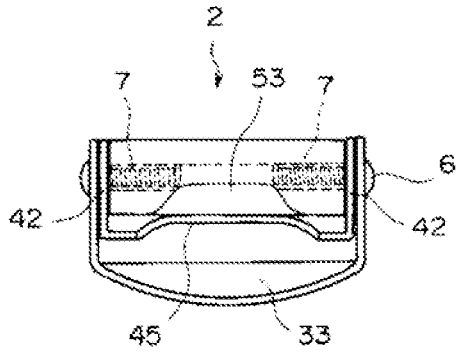
FIG. 3 is a front view of the buckle as viewed from the ratchet insertion side.

FIG. 3 is a front view of the buckle as seen from the ratchet insertion side. This front view of the buckle is explained by referring to FIG. 2 and using the symbols on FIG. 2, because indicating all symbols on this figure makes it look complicated and therefore some symbols are omitted.

The pin 6 inserted into the through holes 31, 31 in the base member 3 is further inserted into the through holes 41, 41 in the engagement/releasing member 4 as well as through holes 51, 51 in the operating member 5.

The through hole 51 is provided so that two coil springs 7, 7 are inserted from the both ends of the hole and the inner tips of the springs are affixed near the center of the hole, and by engaging the outer tips of the two coil springs 7, 7 with the coil spring affixing part 36, the operating member 5 is energized in the clockwise direction. A clearance slightly smaller than the height (thickness) of the tab 21 of the ratchet 20 is provided between the base member 3 and engagement/releasing member 4. There is also a clearance between the engagement/releasing member 4 and operating member 5, and the releasing contact parts 44, 44 of the engagement/releasing member 4 are positioned and provided directly below the pressing convex contact parts 52, 52 of the operating member 5. When the operating part 53 is pulled up, the pressing convex parts 52, 52 contact the releasing convex parts 44, 44 and the engagement/releasing member 4 rotates in the counterclockwise direction.

Figure 4:
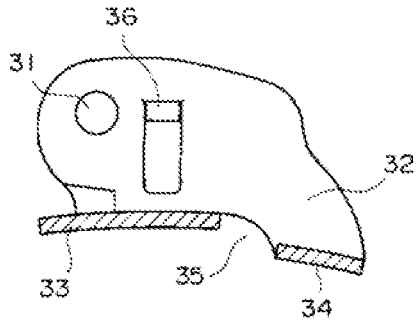
FIG. 4 is a longitudinal section view of the base member of the buckle.

FIG. 4 is a longitudinal section view of the base member of the buckle. The base member 3 is pressed in the shape shown in the longitudinal section view, where through holes 31, 31 are punched in the side wall parts 32, 32, and coil spring affixing parts 36, 36 project at right angles on the side wall parts 32, 32 toward the inner side. The ratchet insertion part 33, strap engagement part 34, and strap engagement hole 35 are formed in the shapes shown in the longitudinal section view.

Figure 5:
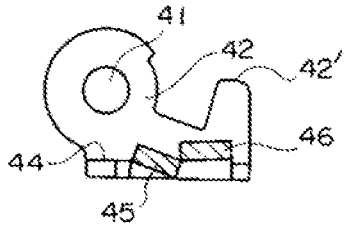
FIG. 5 is a longitudinal section view of the engagement/releasing member of the buckle.

FIG. 5 is a longitudinal section view of the engagement/releasing member of the buckle. The engagement/releasing member 4 is pressed in the shape shown in the longitudinal section view, where through holes 41, 41 are punched in the side wall parts 42, 42, and releasing convex parts 44, 44 are formed on the inner side at the tips of the engagement/releasing parts 43, 43 (not illustrated) toward the inner side. As explained in FIG. 2, the rectangular engagement part 45 is provided on an incline and the center of the center convex part 46 is formed in a convex shape.

Figure 6:
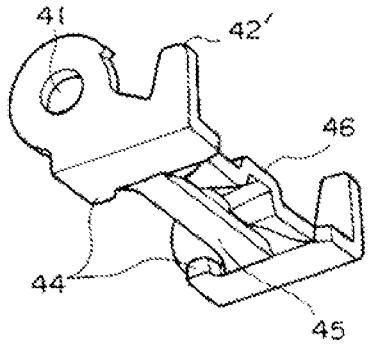
FIG. 6 is a rear perspective view of the engagement/releasing member of the buckle.

FIG. 6 is a rear perspective view of the engagement/releasing member of the buckle. The releasing convex parts 44, 44 are formed on the inner side at the tips of the engagement/releasing parts 43, 43 toward the inner side. The rectangular engagement part 45 is processed in a shape that inclines forward from both ends with slight curving, while the center convex part 46 is processed in a shape that inclines forward from both ends just like the engagement part 45, with the center processed in a convex shape so that the tab 21 of the ratchet 20 can pass. Both ends of the center convex part 46 are engaged with the tab 21 of the ratchet 20 just like the engagement part 45. When the operating part 53 of the operating member 5 is pulled up with fingers and then released, both ends of the center convex part 46 contact the operating member 5 and the engagement/releasing member 4 is returned to the original position at which it is not energized.

The engagement part 45 and both ends of the center convex part 46 cause the ratchet 20 to engage with the buckle 2 by allowing both rear side faces to engage with the tab 21 of the ratchet 20 in two stages for greater safety.

Figure 7:
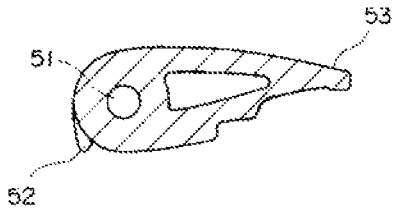
FIG. 7 is a longitudinal section view of the operating member of the buckle.

FIG. 7 is a longitudinal section view of the operating member of the buckle. As mentioned above, the through hole 51 is provided so that two coil springs 7, 7 are inserted from the both ends of the hole, and the inner tips of the coil springs 7, 7 are affixed near the center of the hole, and the pin 6 is also inserted into this hole. The pressing convex parts 52, 52 having a convex flat shape are provided on both forward ends at the front end of the operating member 5, and these pressing convex parts 52, 52 contact the releasing convex parts 44, 44 of the engagement/releasing member 4 when the operating part 53 is pulled up. The operating part 53 having a shape that allows for easy pull-up with fingers is provided at the rear center. To reduce weight, the center or both ends of the operating member 5 may be made hollow.

It should be noted that, although two coil springs were used to add energy in this embodiment, only one coil spring may be used. In this case, the through hole 51 is provided so that one coil spring 7 is inserted from either the left or right end of the hole and the inner tip of the coil spring 7 is affixed near the center of the hole, meaning that the coil spring 7 used must be able to add the same amount of energy as the two coil springs 7, 7 do.

Figure 8:
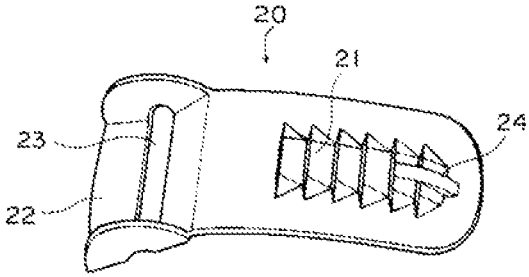
FIG. 8 is a perspective view of the ratchet.
Figure 9:
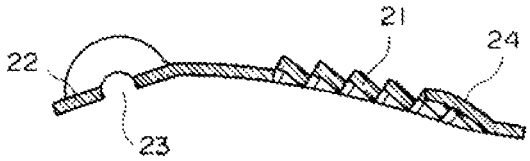
FIG. 9 is a longitudinal section view of the ratchet.

FIG. 8 is a perspective view of the ratchet. This ratchet is manufactured to the structure shown in FIG. 8 by stamping a metal sheet material. A curved part 24 with a gradual curved shape as shown in FIG. 9 is provided at the center tip of the tab 21 of the ratchet 20, where this curved part 24 is provided to facilitate insertion of the ratchet 20 into the buckle 2. The lateral width of the tab 21 is shorter than the width of the engagement part 45.

As mentioned above, the coil springs 7, 7 energize the engagement/releasing member 4 in the clockwise direction, but because the clearance between the base member 3 and engagement/releasing member 4 is slightly smaller than the height (thickness) of the tab 21 of the ratchet 20, the engagement part 45 of the engagement/releasing member 4 is pushed up slightly by the curved part 24 having a curved shape and is rotated to be inserted.

FIG. 9 is a longitudinal section view of the ratchet. As explained in FIG. 8, the tab 21 is formed by stamping a sheet material and therefore surfaces of these members having the thickness of the metal sheet material contact together just like the engagement part 45 engaged with the tab 21. The curved part 24 has a curved shape to facilitate insertion, while also functioning as the tab 21. There are five tabs 21 in this example, but the length difference between the largest and smallest of these five tabs 21 is only around 2 cm and the tab lengths can be adjusted. The number of tabs can be increased or decreased freely as necessary.

Figure 10:
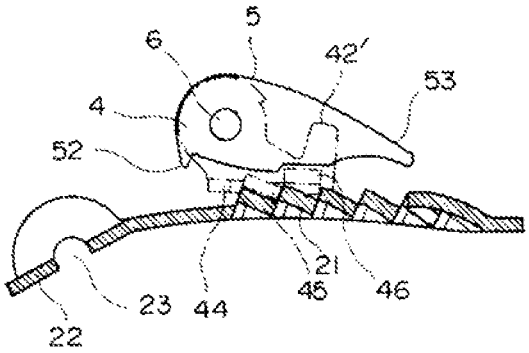
FIG. 10 is a longitudinal section view showing a condition of the ratchet engaged with the engagement/releasing member of the buckle.

FIG. 10 is a longitudinal section view showing a condition of the ratchet engaged with the engagement/releasing member of the buckle.

The symbols indicated on FIG. 10 represent the same components shown in FIGS. 2 and 8 and thus are not explained.

Figure 14:
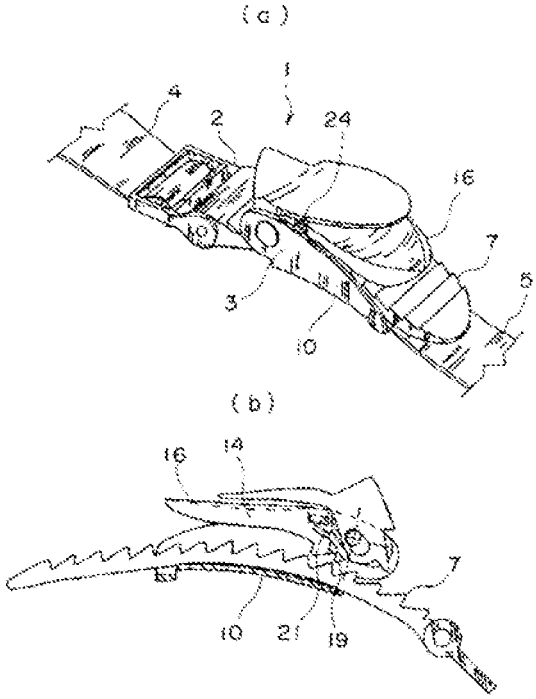
FIG. 14 is a perspective view and longitudinal section view showing the exterior of the conventional motorcycle helmet.

The engagement/releasing member 4 is indicated by an alternate long and short dashed line, while the operating member 5 is indicated by a solid line. The operating member 5 and engagement/releasing member 4 are energized by the coil springs 7, 7 in the clockwise direction around the pin 6, and the engagement part 45 of the engagement/releasing member 4 is engaged with the tab 21 of the ratchet 20. The tab 21 as well as the engagement part 45 and both ends of the center convex part 46 are formed by stamping a stainless steel sheet material as mentioned above, and therefore surfaces of these members having the thickness of this stainless steel sheet material contact together as two stages, meaning that neither component will be damaged even when the helmet receives a strong force from the outside. Also because the stainless steel sheet material can be formed with ease by means of stamping, the manufacturing cost can be kept low. To begin with, the buckle 2 under the present invention is constructed in such a way that the operating part 16 in FIG. 14 showing a prior art is pulled up, not pressed down, which eliminates the possibility of the helmet coming off.

Figure 11:
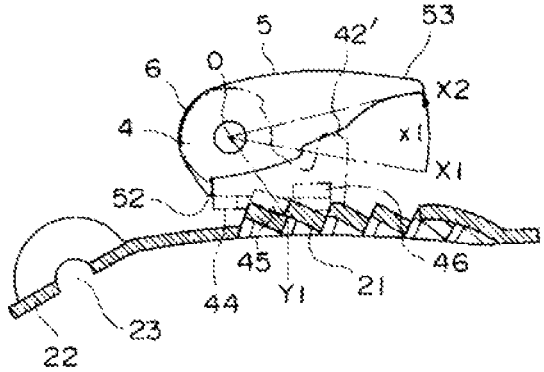
FIG. 11 is a longitudinal section view showing a condition of the ratchet and engagement/releasing member of the buckle being released.

FIG. 11 is a longitudinal section view showing a condition of the ratchet and engagement/releasing member of the buckle being released.

This longitudinal section view shows a condition where the pressing convex parts 52, 52 are contacting the releasing contact parts 44, 44 as a result of pulling up the operating part 53 of the operating member 5, where the pull-up distance is denoted by x1 based on X1 representing the initial position before the rear end of the operating part 53 shown in FIG. 11 is pulled up (hereinafter referred to as "initial position X1") and X2 representing the position at which the rear end of the operating part 53 shown in FIG. 11 is pulled up to contact the releasing contact parts 44, 44 (hereinafter referred to as "contact position X2"). While the engagement part 45 is partially contacting the tab 21, both remain engaged. The operating part 53 can be pulled up by distance x1 with a low force because it is sufficient to apply a force that counters the energy of the coil springs 7, 7. Between the tab 21 and the engagement part 45, as well as both ends of the center convex part 46, surfaces of these members having the thickness of the stainless steel sheet material are contacting together. Symbol O in FIG. 11 indicates the center point of the pin 6, and the alternate long and short dashed line drawn from this center point O extends from there to the bottom edge of the contact surface of the engagement part 45 whose section has a rectangular shape. Symbol Y1 indicates the position of this bottom edge of the contact surface.

Figure 12:
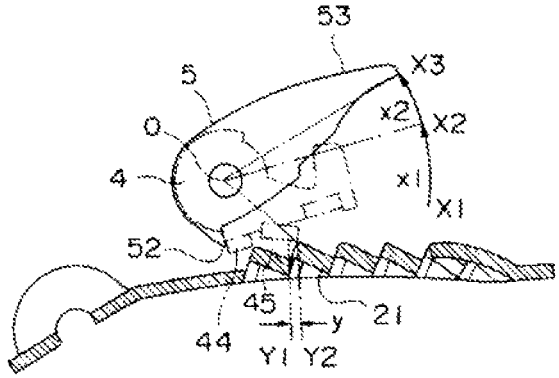
FIG. 12 is a longitudinal section view showing a condition of the moment the ratchet and engagement/releasing member of the buckle are released.
Figure 13:
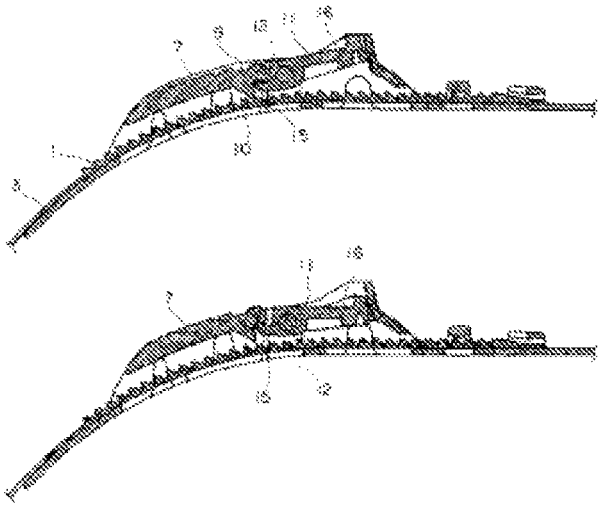
FIG. 13 is a longitudinal section view of a conventional ratchet buckle.

FIG. 12 is a longitudinal section view showing a condition of the moment the ratchet and engagement/releasing member of the buckle are released.

When the operating part 53 is pulled up and the pressing convex parts 52, 52 contact the releasing contact parts 44, 44, the engagement/releasing member 4 receives a force to rotate it in the counterclockwise direction, but because the tab 21 and engagement part 45 surfaces having the thickness of the stainless steel sheet material are contacting, the engagement is maintained until the bottom edge of the contact surface of the engagement part 45 is released from the top edge of the contact surface of the tab 21, and the engagement is released when the bottom edge of this contact surface is released from the top edge of the contact surface. The alternate long and short dashed line drawn from the center point O of the pin 6 as shown in FIG. 12 extends from here to the bottom edge of the contact surface of the engagement part 45 whose section has a rectangular shape. Symbol Y2 indicates the position of the bottom edge of the aforementioned contact surface, or the top edge of the contact surface of the tab 21. The distance over which the rear end of the operating part 53 is pulled up further from contact position X2 in FIG. 12 until the engagement is released at X3, is denoted by x2. This pull-up distance x2 corresponds to distance y over which the bottom edge of the contact surface of the engagement part 45 moves from position Y1 to position Y2. When pulling up the operating part 53 by distance x2, a strong pull-up force must be applied to shorten the engaged condition of the buckle and ratchet further by distance y, where the engagement cannot be released unless a strong pull-up force is applied. Distance x1 is approx. 1.5 times distance x2.

The foregoing reveals the following. The operating part 53 can be pulled up by distance x1 with a low force because it is sufficient to apply a force that counters the energy of the coil springs 7, 7, but the pull-up by distance x2 requires application of a force that shortens the distance by y, and the engagement cannot be released unless the part is pulled up with a strong force. With a conventional ratchet buckle, the engagement was released when the operating part (lever) was pulled up only by distance x2, instead of distance x1. With the ratchet buckle under the present invention, on the other hand, the engagement is released only when the part is pulled up by approx. 1.5 times the conventional distance of x2 and further by distance x2, meaning that the part must be pulled up by at least twice the conventional pull-up distance of 1, and this prevents any wrong or inadvertent lever operation and the helmet will not come off from the head, thereby ensuring safety.

What is claimed is:

1. A ratchet buckle for helmets comprising;

a ratchet adapted to be fastened to a strap provided inside the helmet, wherein multiple tabs for engagement are provided on a surface of the ratchet, and a buckle comprising:

a base member which is a basic structure of the buckle;

an operating member which is rotatably assembled to the base member via a pin through which coil springs are inserted, wherein the operating member is biased by the coil springs in a first direction in which a distal end of the operating member moves toward the base member, said distal end being defined as a rear end distanced more from the pin than a proximal end which is a front end; and an engagement/releasing member having an engagement part and a center convex part, which engagement/releasing member is rotatably assembled via the pin between the base member and the operating member, wherein the engagement part and both ends of the center convex part are configured to selectively engage with one of the multiple tabs, respectively, when an end of the ratchet is inserted into the buckle, wherein this engagement is releasable by pulling up the operating member provided on the buckle;

wherein when the operating member is pulled up and rotated in a second direction in which the rear end of the operating member moves away from the base member, a front end of the operating member contacts a front end of the engagement/releasing member, and when the operating member is further pulled up and rotated in the second direction, the front end of the operating member pushes the front end of the engagement/releasing member to move together in the second direction, the engagement part and both ends of the center convex part of the engagement/releasing member rotate to release an engagement with the tab of the ratchet.

2. A ratchet buckle for helmets according to claim 1, wherein the engagement/releasing member has side wall parts comprising side plates and engagement/releasing parts comprising a bottom plate, wherein the side wall parts have through holes provided in them for inserting the pin, and the engagement/releasing parts have the engagement part and both ends of the center convex part that engage with the tab of the ratchet, as well as releasing convex parts that release an engagement of the engagement part and both ends of the center convex part with the tab of the ratchet when the operating member is pulled up and the front end of the operating member contacts and pushes the releasing convex parts.

3. A ratchet buckle for helmets according to claim 2, wherein the engagement part has a rectangular shape extended in an axial direction of the pin, which rectangular shape inclines in a direction perpendicular to the axial direction of the pin, and the center convex part has a rectangular shape extended in the axial direction of the pin and having both ends which incline in a direction perpendicular to the axial direction of the pin, and the center convex part has a center pressed in a convex shape, and the releasing convex parts have inner tips formed as circular convexes.

4. A ratchet buckle for helmets according to claim 3, wherein the side wall parts have locking parts at rear ends of the side walls each locking part having a trapezoidal convex shape.

5. A ratchet buckle for helmets according to claim 3, wherein the front end of the operating member is such that a pressing convex part having a convex flat shape is provided at both ends on a front.

6. A ratchet buckle for helmets according to claim 5, wherein the front end of the operating member comprises the pressing convex parts, while the front end of the engagement/releasing member comprises the releasing convex parts, and when the pressing convex parts contact the releasing convex parts and the engagement part of the engagement/releasing member rotates, an engagement with the tab of the ratchet is released.

7. A ratchet buckle for helmets according to claim 6, wherein biasing force of the coil springs is such that a pull-up force of the operating member counters the biasing force of the coil springs until the pressing convex parts contact the releasing convex parts, but the pull-up force of the operating member is stronger than the biasing force of the coil spring after the pressing convex parts contact the releasing convex parts until an engagement of the ratchet and the buckle is released.

* * * * *